US009267339B2

(12) United States Patent
Hall

(10) Patent No.: US 9,267,339 B2
(45) Date of Patent: Feb. 23, 2016

(54) DOWNHOLE DEVICE

(75) Inventor: Neil Robert Hall, Aberdeen (GB)

(73) Assignee: WIRELINE ENGINEERING LIMITED, Aberdeen (GB)

( * ) Notice: Subject to any disclaimer, the term of this patent is extended or adjusted under 35 U.S.C. 154(b) by 1023 days.

(21) Appl. No.: 13/257,265

(22) PCT Filed: Mar. 15, 2010

(86) PCT No.: PCT/GB2010/000459

§ 371 (c)(1),
(2), (4) Date: Dec. 5, 2011

(87) PCT Pub. No.: WO2010/106312

PCT Pub. Date: Sep. 23, 2010

(65) Prior Publication Data

US 2012/0061098 A1 Mar. 15, 2012

(30) Foreign Application Priority Data

Mar. 18, 2009 (GB) ..... 0904574.1

(51) Int. Cl.
*E21B 17/10* (2006.01)

(52) U.S. Cl.
CPC ..... *E21B 17/10* (2013.01); *E21B 17/1057* (2013.01); *E21B 17/1064* (2013.01)

(58) Field of Classification Search
CPC ..... E21B 17/1057; E21B 17/1064
USPC ..... 166/241.1, 241.3, 241.5; 175/325.3
See application file for complete search history.

(56) References Cited

U.S. PATENT DOCUMENTS

| | | | | |
|---|---|---|---|---|
| 1,733,336 | A | 10/1929 | De Costa | |
| 2,466,239 | A * | 4/1949 | Holcombe | 166/176 |
| 4,474,235 | A * | 10/1984 | Coshow | 166/241.5 |
| 4,624,313 | A * | 11/1986 | Coshow | 166/241.5 |
| 6,250,394 | B1 | 6/2001 | Mashburn | |
| 7,188,671 | B2 * | 3/2007 | Al-Zahrani | 166/250.01 |
| 7,395,881 | B2 * | 7/2008 | McKay et al. | 175/325.3 |
| 2006/0070733 | A1 | 4/2006 | Al-Zahrani | |
| 2008/0164018 | A1 | 7/2008 | Hall | |

FOREIGN PATENT DOCUMENTS

| | | |
|---|---|---|
| EP | 0159801 A1 | 10/1985 |
| GB | 2 449 566 | 11/2008 |
| GB | 2 450 632 | 12/2008 |
| WO | WO 01/40615 | 6/2001 |
| WO | WO 02/66779 | 8/2002 |
| WO | WO 2005/111368 | 11/2005 |
| WO | WO 2006/041880 | 4/2006 |
| WO | WO 2009/065588 | 5/2009 |

OTHER PUBLICATIONS

European Patent Office, Examination Report, Patent Application No. 10 709 568.9, Aug. 28, 2012, three pages.

(Continued)

*Primary Examiner* — Giovanna C Wright
(74) *Attorney, Agent, or Firm* — Fenwick & West LLP

(57) ABSTRACT

A downhole device for use in a deviated well is described. The downhole device comprises a device body having a longitudinal axis, the device body adapted to be connected to the end of a tool string and a guide member. At least a portion of the guide member is moveable with respect to the device body, one of said moveable portions defining the leading end of the device.

38 Claims, 3 Drawing Sheets

(56) References Cited

OTHER PUBLICATIONS

United Kingdom Intellectual Property Office, Application No. GB 1008895.3, Combined Search and Examination Report, Jul. 12, 2010, two pages.

PCT International Search Report and Written Opinion, PCT Application No. PCT/GB2010/000459, Sep. 19, 2010, nine pages.

Anonymous Third-party Correspondence to the United Kingdom Intellectual Property Office dated May 7, 2013, in re UK Patent Application No. 1008895.3, twelve pages.

Communication pursuant to Article 94(3) EPC for European Patent Application No. EP 10709568.9, Oct. 21, 2015, 5 Pages.

* cited by examiner

DOWNHOLE DEVICE

FIELD OF THE INVENTION

The present invention relates to an improved downhole device, particularly, but not exclusively, to an improved downhole device for use in deviated well bores.

BACKGROUND TO THE INVENTION

In the oil and gas industry, hydrocarbon reservoirs have conventionally been accessed by vertical or near-vertical bores. With finite reserves and a high demand for supplies, extraction of oil and gas from less-accessible reservoirs has become more widespread. To reduce cost, technologies have been developed which allow these reservoirs to be accessed by existing well bores using deviated drilling techniques, that is the reservoir is accessed by drilling a bore at an angle from an existing vertical bore.

Tools that have conventionally been used in vertical or near-vertical bores may encounter problems when used in bores that deviate from vertical. Such tools are lowered in to the bore as part of a tool string and utilises gravity to facilitate transport. In non-vertical bores the gravitational force may be negated by frictional forces resisting movement between the tool string and the walls of the bore. Furthermore, particularly in open hole, the tool string outer surface can stick to the wall of the well bore.

In an attempt to alleviate such problems, the present applicant has proposed a system that reduces friction. Such a downhole device incorporating, for example, a roller is disclosed in the applicant's international application WO 2006/016155. Accordingly, equipment can be more easily transported along bores (cased, open hole or a cased to open hole cement pocket for example) where the increased friction caused by deviation from vertical is minimised by the rolling contact. The use of such equipment helps increase the accessibility of non-vertical bores.

In addition to the increased friction in such bores due to an increased horizontal gradient component, the movement of equipment along such bores may be impeded further by the presence of intermediary obstacles. Wash-outs, sharp bends, misaligned tubular joins, cased to cement pocket entries, uneven surfaces and the like may present sporadic increased resistance to the movement of such equipment. Particularly where equipment first encounters such obstacles, the localised increased friction may impede the movement of equipment through a bore.

SUMMARY OF THE INVENTION

According to a first aspect of the present invention there is provided a downhole device for use in a deviated well, the downhole device comprising:

a device body having a longitudinal axis, the device body adapted to be connected to the end of a tool string; and a guide member;

wherein at least a portion of the guide member is moveable with respect to the device body, one of said moveable portions defining the leading end of the device.

In one embodiment the present invention provides a device which, when attached to a tool string, forms the leading end of the tool string as it is lowered into a deviated well bore. The moveable guide member portion assists in progression of the tool string along the deviated well bore by climbing or generating a path through accumulated debris (sand, mud cake, grit for example) and in the event of a large accumulation of debris or large washout ledge, the guide member portion can move with respect to the device body permitting further movement of the device and the tool string into the well bore.

In one embodiment the device body has a first end adapted to be connected to the end of the tool string, a second end connected to the guide member and a longitudinal axis.

A first portion of the guide member may be adapted to rotate with respect to the device body.

The guide member first portion may be adapted to rotate about an axis perpendicular to the device body longitudinal axis.

Alternatively or additionally the guide member first portion may be adapted to rotate about an axis parallel to, or coinciding with, the device longitudinal axis.

The device may comprise a guide member second portion.

The guide member first portion may be moveable with respect to the guide member second portion.

The guide member second portion may be moveable with respect to the device body.

The direction of movement of the guide member first portion with respect to the guide member second portion may be different to the direction of movement of the guide member second portion with respect to the device body. Such an arrangement provides movement in three directions.

In one embodiment the direction of movement of the first guide member portion may be perpendicular to the direction of movement of the second guide member portion.

In one embodiment the guide member first portion is adapted to rotate about an axis perpendicular to the device body longitudinal axis and the guide member second portion is adapted to rotate about the device body longitudinal axis.

In alternative embodiments, the guide member second portion may be fixed with respect to the device body.

In an embodiment where the guide member first portion rotates about an axis perpendicular to a device body longitudinal axis, the guide member first portion defines the leading end of the device.

In this embodiment, the guide member first portion may be adapted to provide a rolling contact between the guide member and the surface of a bore.

The leading end of the moveable portion may be at a location on the moveable portion adjacent the device body axis. Where, for example, the moveable portion defining the leading end of the device is a roller, the roller will assist in lifting the tool string up and over the obstacle and the utility of the roller is increased if the leading edge is at least as high as the device body axis.

In one embodiment the guide member first portion is adapted to self align with respect to the device body.

In one embodiment the guide member first portion is weighted such that it self-aligns.

Alternatively or additionally, the guide member first portion may be shaped to self-align.

The guide member first portion may self-align by rotation of the guide member second portion with respect to the device body.

In one embodiment the guide member first portion comprises a pair of rollers and an axle.

In one embodiment the rollers and the axle are a unitary component.

Each roller may comprise a projecting part.

The projecting part may project perpendicular to the device axis.

In one embodiment the projecting part of each roller is an eccentrically-shaped part.

The eccentrically-shaped part may comprise an oval shape which extends from the outer diameter of the roller to the end of the projecting portion. An oval-shaped member has a weight distribution which applies a force to self align the guide member with respect to the device body. Furthermore the profile of an oval-shaped member assists in aligning the/each roller.

In one embodiment the guide member second portion is adapted to self-align. The guide member second portion may have a region defining an oval cross-section.

The guide member second portion may define a narrowed portion.

The narrow portion may define the guide member second portion leading edge.

The narrowed portion may be adapted to receive the guide member first portion.

The guide member second portion may have a longitudinal axis.

The second portion longitudinal axis may coincide with the device body longitudinal axis.

The guide member second portion may be adapted to deflect away from the device body axis.

In one embodiment the guide member second portion is biased towards the device body axis.

The guide member second portion may be connected to the device body by means of a universal joint.

The guide member second portion may be biased towards the device body axis by means of a spring.

The spring may be a disc spring.

In an alternative embodiment, the guide member second portion may be connected to the device body by means of a manually adjusted mechanical clock device. A manually adjusted mechanical clock device will point the first guide member portion to a clock face position and has a weight biased mechanism to initiate and keep the first guide member portion on this heading The guide member first portion may be detachably mounted to the guide member second portion.

The/each moveable portion may define a surface or profile adapted to improve grip.

Where the moveable portion is rotatable, the profile or surface may be adapted to assist rotation.

The device body may comprise a downhole tool.

In one embodiment the device body comprises a roller sub, roller skate or roller bogie facilitating translation of the tool string through a well bore.

According to a second aspect of the present invention there is provided a method of guiding a tool string through a deviated wellbore, the method comprising the steps of:

providing a downhole device at the end of a tool string;

translating the tool string through a deviated wellbore, the leading end of the device being defined by a guide member portion, the guide member portion being moveable with respect to a device body.

BRIEF DESCRIPTION OF THE DRAWINGS

An embodiment of the present invention will now be described with reference to the accompanying drawings in which.

DETAILED DESCRIPTION OF THE DRAWINGS

Figure 1:
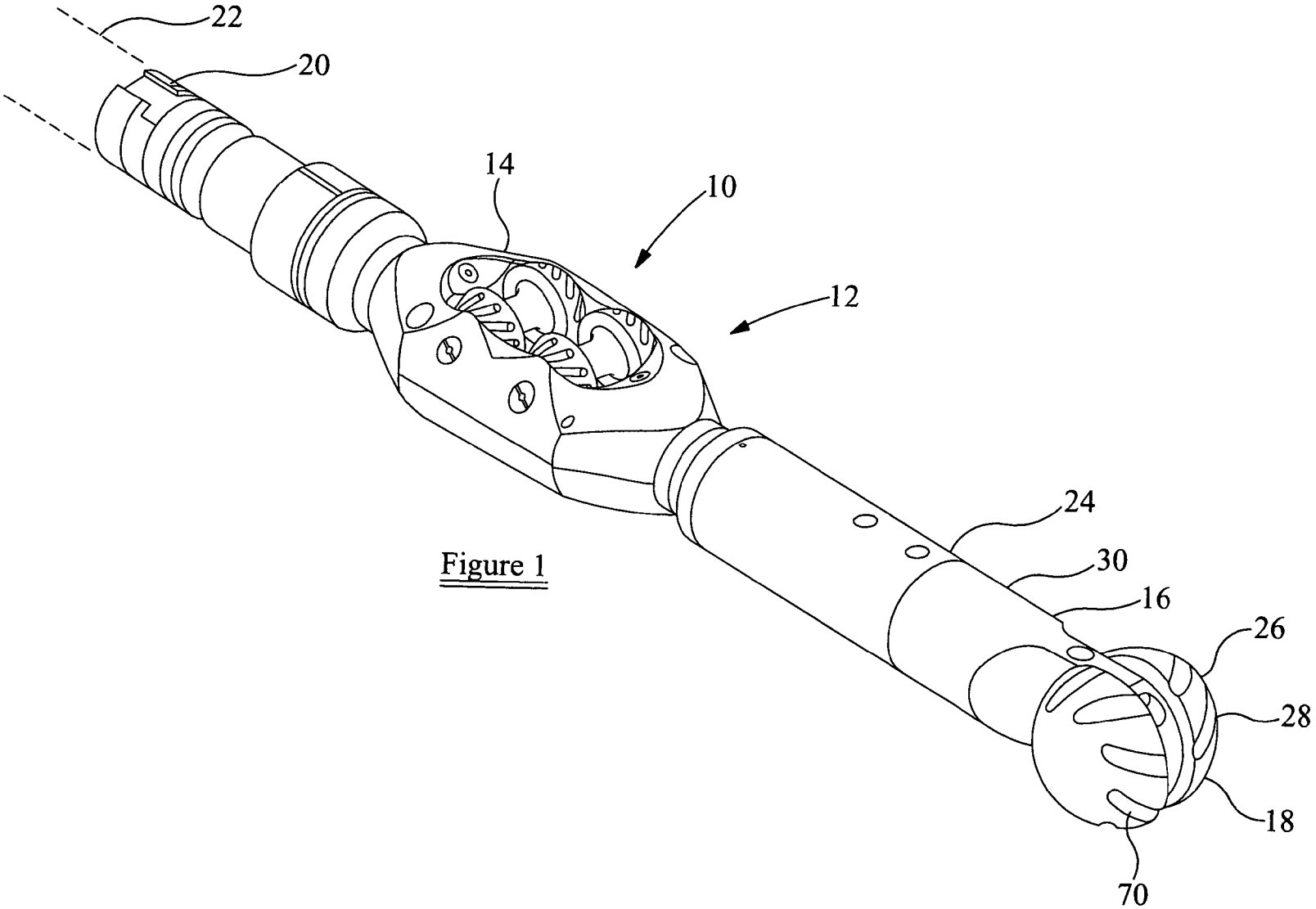
FIG. 1 is a perspective view of a downhole device for use in a deviated well according to a first embodiment of the present invention.
Figure 2:
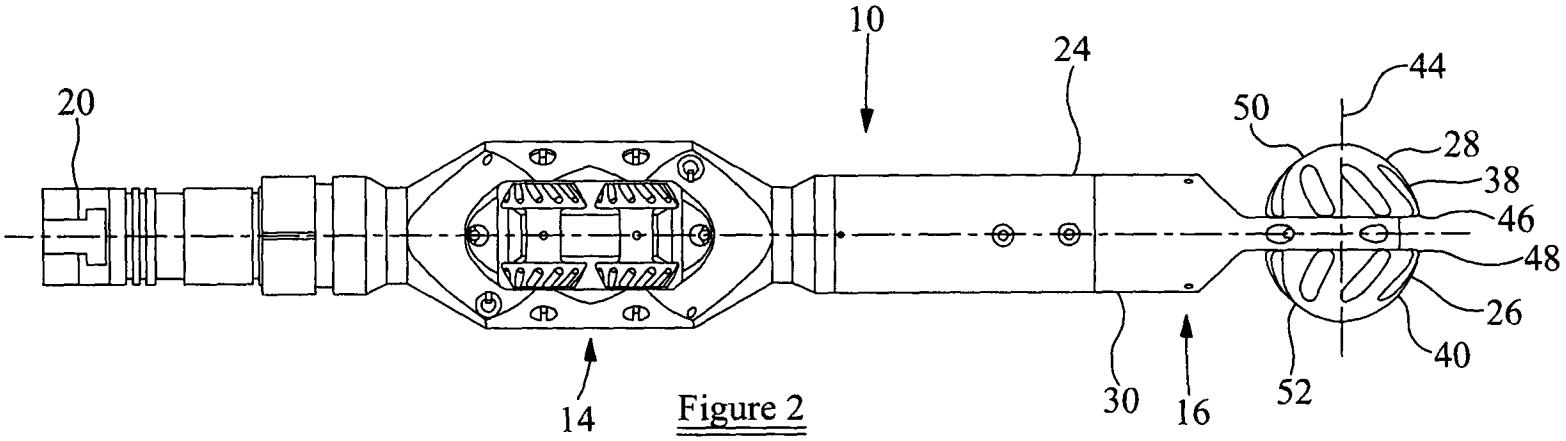
FIG. 2 is a plan view of the downhole device of FIG. 1.
Figure 3:
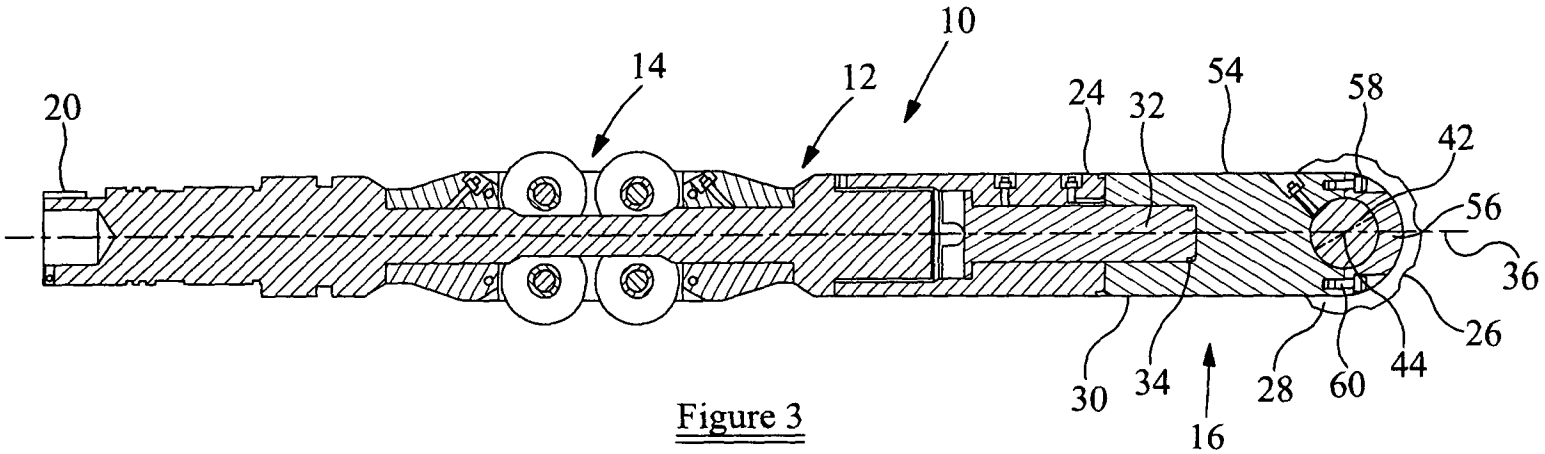
FIG. 3 is a section view through line A-A on FIG. 2 of the device of FIG. 1.

Referring firstly to FIGS. 1, 2 and 3, there is shown perspective, plan and section views respectively of a downhole device, indicated by reference numeral 10, for use in a deviated well.

The downhole device 10 comprises a device body 12, comprising a roller bogie 14 and a guide member 16.

The device body 12 has a first end 20 adapted to be connected to a tool string 22 (shown in broken outline on FIG. 1), a second end 24 connected to the guide member 16 and a longitudinal axis 36. The guide member 16 comprises a first portion 26, in the form of a roller unit 28, and a second portion 30. The roller unit 28 defines the leading end of the device 10.

Referring to FIG. 3, the device body 12 defines a spigot 32 which fits in a recess 34 defined by the guide member second portion 30. The guide member second portion 30 rotates about this spigot 32, the axis of rotation of the guide member second portion 30 coinciding with the device body longitudinal axis 36.

The guide member first portion 26 is a unitary component comprising first and second rollers 38, 40 linked by an axle 42 (FIG. 3). The axis of rotation 44 of the roller unit 28 is perpendicular to, and intersects, the device body longitudinal axis 36.

As can be seen from the Figures, the guide member first portion 26 and the guide member second portion 30 are both moveable with respect to the device body 12, the plane of rotation of each of the portions 26, 30 being perpendicular to each other.

Referring to FIG. 2, the first and second rollers 38, 40 each have an eccentrically shaped projecting portion 50, 52 and a rolling edge 46, 48. By shaping the projecting portions 50, 52 eccentrically, if contact is made between one of the projecting portions 50, 52 and a wellbore, the guide member 16 will rotate to bring the roller unit 28 onto its rolling edges 46, 48, therefore the roller unit 28 is self aligning to roll on the rolling edges 46, 48.

Figure 4:
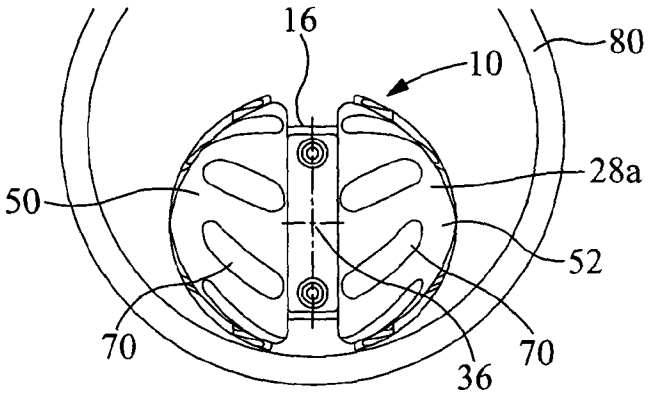
FIG. 4 is an end view of the device of FIG. 1 shown on a pipe.
Figure 5:
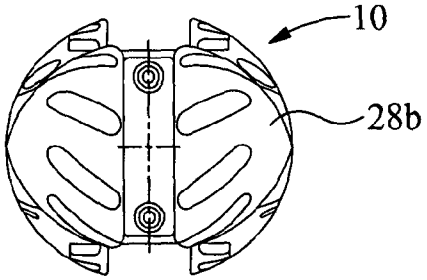
FIG. 5 is an end view of the device of FIG. 1 with an alternative roller portion.
Figure 6:
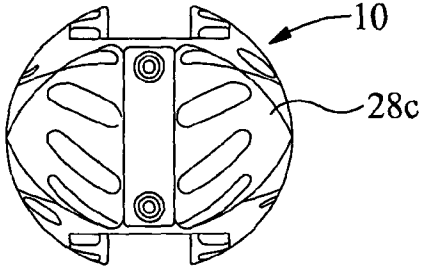
FIG. 6 is an end view of the device of FIG. 1 with a further alternative roller portion.

Referring to FIG. 3 the guide member second portion 30 comprises a first part 54 and a second part 56, the first and second parts 54, 56 being secured to one another by screws 58, 60. By removing the screws 58, 60 the first and second parts 54, 56, separate releasing the roller unit 28. This permits roller units 28 of different sizes to be accommodated on one device 10. Referring to FIGS. 4, 5 and 6, end views of the downhole device 10 are shown with three different sizes of roller unit 28*a*, 28*b*, 28*c*. An appropriate roller unit 28 can be selected depending on the downhole conditions which have to be overcome to pilot a path through downhole debris Referring to FIG. 4, an end view of the device of FIG. 1 shown in a well bore 80, it will be noted that by providing the leading end or first point of contact of the device 10 on the roller unit 28, increased utility of the device 10 is provided. The roller unit 28 allows for a rolling contact to be made at heights up to and including the longitudinal device body axis 36. Should an obstacle of this height be encountered, the device 10 may be able to roll over the obstacle lifting the downhole tool with it or clear a path by moving the obstacle out of the way. Alternatively should the obstacle encounter the eccentric projecting portions 50, 52 the guide member second portion 30 can rotate about the device axis 36 further increasing the chances of the device 10 being able to bypass the obstacle. It will be noted that the rollers define recesses 70 which can grip the surface of the wellbore and improve traction between the device 10 and the wellbore.

Various modifications and improvements may be made to the above-described embodiment without departing from the scope of the invention. For example, although the interface between the guide member second portion 30 and the device body 12 is a rotational one it could be for example in the form of a universal joint such that the second portion 30 can additionally or alternatively deflect away from the device axis 36.

In some embodiments a biasing device will be incorporated to bias the guide member second portion 30 to a position in which it is aligned with the device axis 36.

The invention claimed is:

1. A downhole device comprising:

a device body having a longitudinal axis, the device body adapted to be connected to an end of a tool string; and a guide member comprising a first portion and a second portion, the first portion being carried by the second portion;

wherein the first portion of the guide member comprises a roller unit having a greater transverse outer dimension than the second portion at least substantially around the device body longitudinal axis and is rotatable with respect to the device body about an axis perpendicular to the longitudinal axis, the guide member first portion defining the leading end of the device, and wherein the second portion extends along the device body longitudinal axis.

2. The downhole device of claim 1, wherein the device body has a first end adapted to be connected to the end of the tool string and a second end connected to the guide member.

3. The downhole device of claim 1, wherein the guide member first portion is adapted to rotate about an axis parallel to, or coinciding with, the device body longitudinal axis.

4. The downhole device of claim 1, wherein the guide member first portion is moveable with respect to the guide member second portion.

5. The downhole device of claim 1, wherein the guide member second portion is moveable with respect to the device body.

6. The downhole device of claim 1, wherein the direction of movement of the guide member first portion with respect to the guide member second portion is different to the direction of movement of the guide member second portion with respect to the device body.

7. The downhole device of claim 6, wherein the direction of movement of the first guide member portion is perpendicular to the direction of movement of the second guide member portion.

8. The downhole device of claim 6, wherein the guide member first portion is adapted to rotate about an axis perpendicular to the device body longitudinal axis and the guide member second portion is adapted to rotate about the device body longitudinal axis.

9. The downhole device of claim 1, wherein the guide member second portion is fixed with respect to the device body.

10. The downhole device of claim 1, wherein the guide member first portion is adapted to provide a rolling contact between the guide member and the surface of a bore.

11. The downhole device of claim 1, wherein the guide member first portion is adapted to self-align with respect to the device body.

12. The downhole device of claim 11, wherein the guide member first portion is shaped to self-align.

13. The downhole device of claim 1, wherein the guide member first portion comprises a pair of rollers and an axle.

14. The downhole device of claim 13, wherein each roller comprises a projecting part.

15. The downhole device of claim 14, wherein the projecting part projects perpendicular to the longitudinal axis.

16. The downhole device of claim 1, wherein the guide member second portion is adapted to self-align.

17. The downhole device of claim 16, wherein the guide member second portion has a region defining an oval cross-section.

18. The downhole device of claim 1, wherein the guide member second portion defines a narrowed portion.

19. The downhole device of claim 18, wherein the narrowed portion defines the guide member second portion leading edge.

20. The downhole device of claim 18, wherein the narrowed portion is adapted to receive the guide member first portion.

21. The downhole device of claim 1, wherein the guide member second portion has a longitudinal axis.

22. The downhole device of claim 21, wherein the guide member second portion longitudinal axis coincides with the device body longitudinal axis.

23. The downhole device of claim 1, wherein the guide member first portion is detachably mounted to the guide member second portion.

24. The downhole device of claim 1, wherein the first portion defines a surface or profile adapted to improve grip.

25. The downhole device of claim 24, wherein, the profile is adapted to assist rotation.

26. The downhole device of claim 1, wherein the device body comprises a downhole tool.

27. The downhole device of claim 1, wherein the leading end of the first portion is at a location on the first portion adjacent the device body axis.

28. The downhole device of claim 1, wherein the guide member first portion comprises first and second rollers.

29. The downhole device of claim 28, wherein first and second rollers are symmetrically disposed around the device body longitudinal axis.

30. A downhole device comprising:

a device body having a longitudinal axis, the device body adapted to be connected to an end of a tool string; and a guide member comprising a first portion and a second portion, the first portion being carried by the second portion;

wherein the first portion of the guide member comprises a roller unit having a greater transverse outer dimension than the second portion around the device body longitudinal axis and is rotatable with respect to the device body about an axis perpendicular to the longitudinal axis, the guide member first portion defining the leading end of the device, and wherein the second portion extends along the device body longitudinal axis, the guide member first portion being adapted to self-align with the respect to the device body, and the guide member first portion being weighted so as to self-align.

31. A downhole device comprising:

a device body having a longitudinal axis, the device body adapted to be connected to an end of a tool string; and a guide member comprising a first portion and a second portion, the first portion being carried by the second portion;

wherein the first portion of the guide member comprises a roller unit having a greater transverse outer dimension than the second portion around the device body longitudinal axis and is rotatable with respect to the device body about an axis perpendicular to the longitudinal axis, the guide member first portion defining the leading end of the device, and wherein the second portion extends along the device body longitudinal axis, the guide member first portion being adapted to self-align with the respect to the device body, and the guide member first portion self-aligns by rotation of the guide member second portion with respect to the device body.

32. A downhole device comprising:

a device body having a longitudinal axis, the device body adapted to be connected to an end of a tool string; and a guide member comprising a first portion and a second portion, the first portion being carried by the second portion;

wherein the first portion of the guide member comprises a roller unit having a greater transverse outer dimension than the second portion around the device body longitudinal axis and is rotatable with respect to the device body about an axis perpendicular to the longitudinal axis, the guide member first portion defining the leading end of the device, and wherein the second portion extends along the device body longitudinal axis, wherein the guide member first portion comprises a pair of rollers and an axle and the rollers and the axle are a unitary component.

33. A downhole device comprising:

a device body having a longitudinal axis, the device body adapted to be connected to an end of a tool string; and a guide member comprising a first portion and a second portion, the first portion being carried by the second portion;

wherein the first portion of the guide member comprises a roller unit having a greater transverse outer dimension than the second portion around the device body longitudinal axis and is rotatable with respect to the device body about an axis perpendicular to the longitudinal axis, the guide member first portion defining the leading end of the device, and wherein the second portion extends along the device body longitudinal axis, and wherein the guide member first portion comprises a pair of rollers and an axle, each roller comprises a projecting part, and the projecting part of each roller is an eccentrically-shaped part.

34. The downhole device of claim 33, wherein the eccentrically-shaped part comprises an oval shape which extends from the outer diameter of the roller to the end of the projecting portion.

35. A downhole device comprising:

a device body having a longitudinal axis, the device body adapted to be connected to an end of a tool string; and a guide member comprising a first portion and a second portion, the first portion being carried by the second portion;

wherein the first portion of the guide member comprises a roller unit having a greater transverse outer dimension than the second portion around the device body longitudinal axis and is rotatable with respect to the device body about an axis perpendicular to the longitudinal axis, the guide member first portion defining the leading end of the device, and wherein the second portion extends along the device body longitudinal axis, wherein the guide member second portion has a longitudinal axis which coincides with the device body longitudinal axis, and wherein the guide member second portion is adapted to deflect away from the device body longitudinal axis.

36. A downhole device comprising:

a device body having a longitudinal axis, the device body adapted to be connected to an end of a tool string; and a guide member comprising a first portion and a second portion, the first portion being carried by the second portion;

wherein the first portion of the guide member comprises a roller unit having a greater transverse outer dimension than the second portion around the device body longitudinal axis and is rotatable with respect to the device body about an axis perpendicular to the longitudinal axis, the guide member first portion defining the leading end of the device, and wherein the second portion extends along the device body longitudinal axis, wherein the guide member second portion has a longitudinal axis which coincides with the device body longitudinal axis, and wherein the guide member second portion is connected to the device body by means of a universal joint.

37. A downhole device comprising:

a device body having a longitudinal axis, the device body adapted to be connected to an end of a tool string; and a guide member comprising a first portion and a second portion, the first portion being carried by the second portion;

wherein the first portion of the guide member comprises a roller unit having a greater transverse outer dimension than the second portion around the device body longitudinal axis and is rotatable with respect to the device body about an axis perpendicular to the longitudinal axis, the guide member first portion defining the leading end of the device, and wherein the second portion extends along the device body longitudinal axis, and wherein the device body comprises a roller sub, roller skate or roller bogie facilitating translation of the tool string through a well bore.

38. A method of guiding a tool string through a wellbore, the method comprising the steps of:

providing a downhole device at the end of a tool string;

translating the tool string through a wellbore, the leading end of the device being defined by a guide member portion comprising a first portion and a second portion, the first portion being carried by the second portion, the guide member portion being moveable with respect to a device body, the device body having a longitudinal axis, wherein the first portion of the guide member comprises a roller unit having a greater transverse outer dimension than the second portion at least substantially around the device body longitudinal axis and is adapted to rotate with respect to the device body about an axis which is perpendicular to the device body longitudinal axis, the guide member first portion defining the leading end of the device, and wherein the guide member second portion extends along the device body longitudinal axis.

* * * * *